US005093994A

United States Patent [19]

Karas

[11] Patent Number: 5,093,994

[45] Date of Patent: Mar. 10, 1992

[54] DOUBLE ENDED-RETRACTABLE KNIFE

[75] Inventor: Nick J. Karas, Bradenton, Fla.

[73] Assignee: Christine Bringman, Bradenton, Fla.

[21] Appl. No.: 585,662

[22] Filed: Sep. 20, 1990

[51] Int. Cl.[5] ..... B25F 3/00

[52] U.S. Cl. ..... 30/125; 30/162

[58] Field of Search ..... 30/162, 163, 335, 336, 30/125

[56] References Cited

U.S. PATENT DOCUMENTS 2,736,960 3/1956 Armstrong ..... 30/335

3,660,896 5/1972 Umholtz ..... 30/162

*Primary Examiner*—Douglas D. Watts

*Attorney, Agent, or Firm*—Charles J. Prescott

[57] ABSTRACT

A double-ended retractable knife having a blade carrier slidably mounted and selectively positionable longitudinally within a housing from a central stored position in either direction to an in-use position. The blade carrier securely positions a blade extending from each end thereof such that one of the blades selectively extends longitudinally from a blade opening at each end of the housing. The device preferably includes both a straight-edged and a hook-edged blade for added versatility and an interior storage compartment for holding extra blades.

9 Claims, 2 Drawing Sheets

DOUBLE ENDED-RETRACTABLE KNIFE

BACKGROUND OF THE INVENTION

This invention relates generally to knife handles having replaceable blades, and more particularly to a double-ended retractable-bladed utility knife.

A considerable effort has been expended in the development of various types of utility knives. In particular, a number of such devices known to applicant include retractable blades and various detail improvements thereto. One such utility knife is disclosed in U.S. Pat. No. 4,586,256 to Weimann, while another such device is disclosed in U.S. Pat. No. 4,621,425 to Stoutenberg.

A number of other patented devices are known to applicant but none of these devices listed herebelow are directed to the double-ended retractable feature of the present invention:

| | |
|---|---|
| Quenot | 3,857,176 |
| Quenot | 3,872,591 |
| Roll | 3,879,847 |
| Anderson | 4,109,380 |
| Gilbert | 4,209,900 |
| Quenot | Re. 30,733 |
| Qsada | 4,292,738 |
| Gilbert | 4,361,958 |
| Okada | 4,389,776 |
| Wenzel | 4,575,940 |
| Reed, Jr. | 4,651,419 |
| Decker | 4,660,287 |
| Decker | 4,646,440 |
| Castelluzzo | 4,813,132 |
| Knoop | 4,835,865 |

BRIEF SUMMARY OF THE INVENTION

This invention is directed to a double-ended retractable knife having a blade carrier slidably mounted and selectively positionable longitudinally within a housing from a central stored position in either direction to an in-use position. The blade carrier securely positions a blade extending from each end thereof such that one of the blades selectively extends longitudinally from a blade opening at each end of the housing. The device preferably includes both a straight-edged and a hook-edged blade for added versatility and an interior storage compartment for holding extra blades.

It is therefore an object of this invention to provide a double-ended retractable-bladed utility knife handle.

It is another object of this invention to provide a double-ended retractable knife handle which includes both a straight blade and a hook blade, one disposed at each end for selective use.

In accordance with these and other objects which will become apparent hereinafter, the instant invention will now be described with reference to the accompanying drawings.

DETAILED DESCRIPTION OF THE INVENTION

Figure 3:
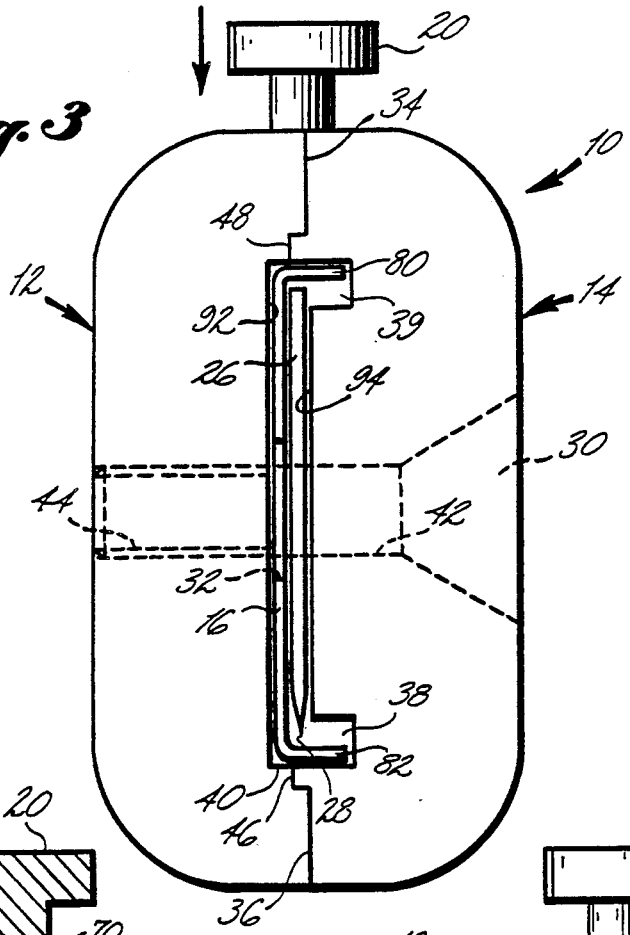
FIG. 3 is a view in the direction of arrows 3—3 in FIG. 1.

Referring now to the drawings, the invention is shown generally at numeral 10 and includes two mating housing halves 12 and 14 which are held together by transverse threaded fastener 30 which passes through hole 42 and aperture 32 of blade carrier 16 and threadably engages into threaded hole 44 as best seen in FIG. 3.

Each housing half 12 and 14 includes interior mating structure which combines to form a longitudinal, elongated C-shaped channel formed by spaced central longitudinal planer surfaces 92 and 94 and guide rails or channels 38 ad 39. Slidably disposed within this C-shaped channel is an elongated blade carrier 16 which has a C-shaped cross section which slidably engages between planer surfaces 92 and 94 and guide rails 38 and 39 as best seen in FIG. 3.

Figure 1:
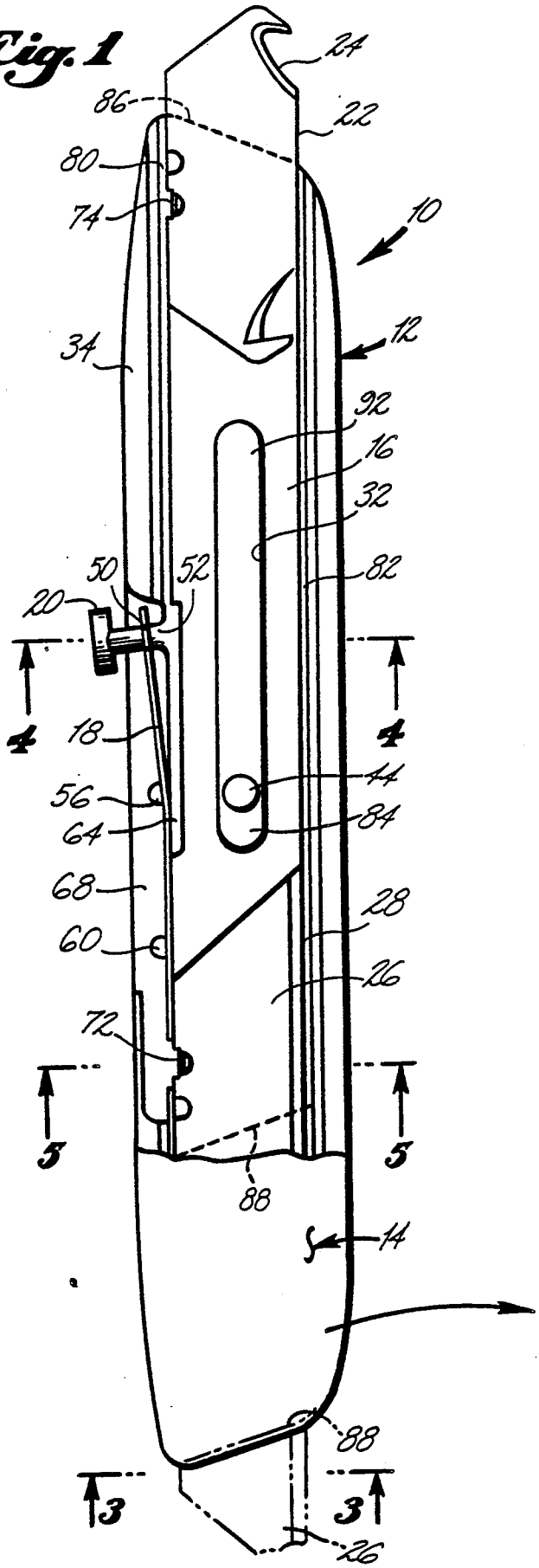
FIG. 1 is a side elevation, partially broken view of the invention.

This blade carrier 16 includes flanges 80 and 82 which slidably mate within guide rails 38 and 39 and is sized so as to securely receive a blade 22 or 26 disposed at each end thereof as best seen in FIG. 1. These blades 22 and 26 are of a well-known structure having notches along one edge which will securely mate within tabs 72 and 74 of blade carrier 16 so as to prevent longitudinal movement of the blades 22 and 26.

The preferred embodiment of the invention 10 includes a blade 26 having a straight cutting edge 28 and a blade 22 having a hooked cutting surface 24 for cutting rope, carpet, asbestos and vinyl tile and the like. These blades 22 and 26 are reversible for extended use.

Figure 2:
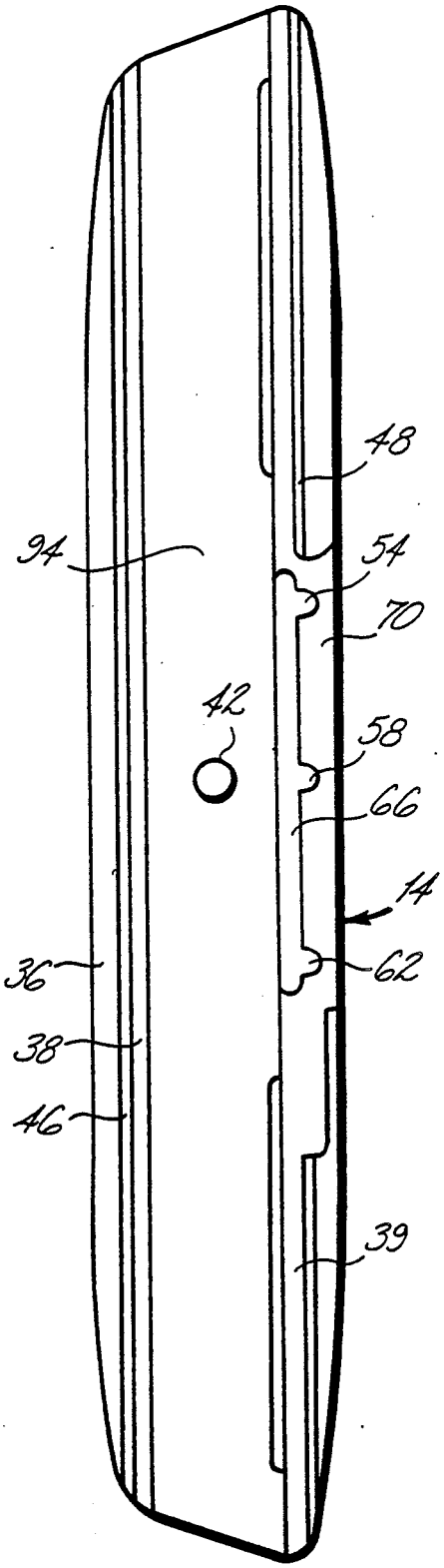
FIG. 2 is a side elevation view of the removed mating half of the knife handle shown in FIG. 1.
Figure 4:
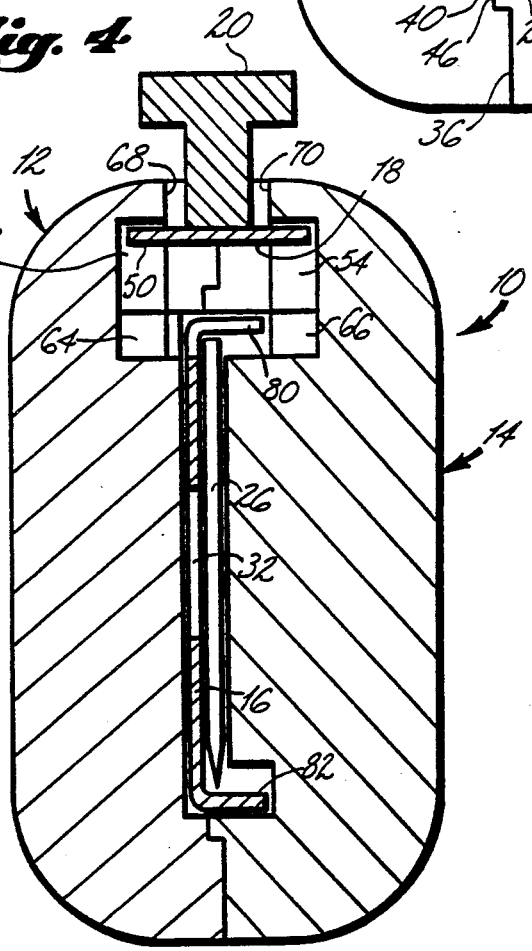
FIG. 4 is a section view in the direction of arrows 4—4 in FIG. 1.

The upper flange 80 has a detached portion 18 which is outwardly curved as best seen in FIGS. 1 and 4. Connected near the free end of the curved detached flange portion 18 is a release button 20. Immediately adjacent the connection between release button 20 and the free end of detached flange portion 18 are laterally extending tabs 50 which engage one of a plurality of detents 52/54, 56/58, and 60/62 formed into the interior surfaces of housing halves 12 and 14. These detents 52/54, 56/58, and 60/62 are formed adjacent a release button slot formed between surfaces 68 and 70 as best seen in FIGS. 1, 2 and 4. Thus, by this arrangement, the upwardly biasing action of detached flange portion 18 urges release button 20 outwardly and tabs 50 lockably into one of the detents 52/54, 56/58, or 60/62.

When the release button 20 is in the position shown in FIG. 1, hooked blade 22 extends from the end of the device 10 for use as shown. When release button 20 is positioned adjacent detent 60/62, blade 26 is in its extended position as shown in phantom. The stored position of the device 10 is wherein release button 20 is positioned adjacent detents 56/58 and both blades 22 and 26 are fully within the ends of the device 10.

In order to insure positive positioning between the housing halves 12 and 14, ribs 46 and 48 are formed into housing half 14 which matably engage into corresponding surface of housing half 12 as best seen in FIGS. 1, 2, and 3. Mating surfaces 34 and 36 of halves 12 and 14, respectively, are laterally offset as best seen in FIG. 3 so as to effect positive lateral alignment therebetween.

Figure 5:
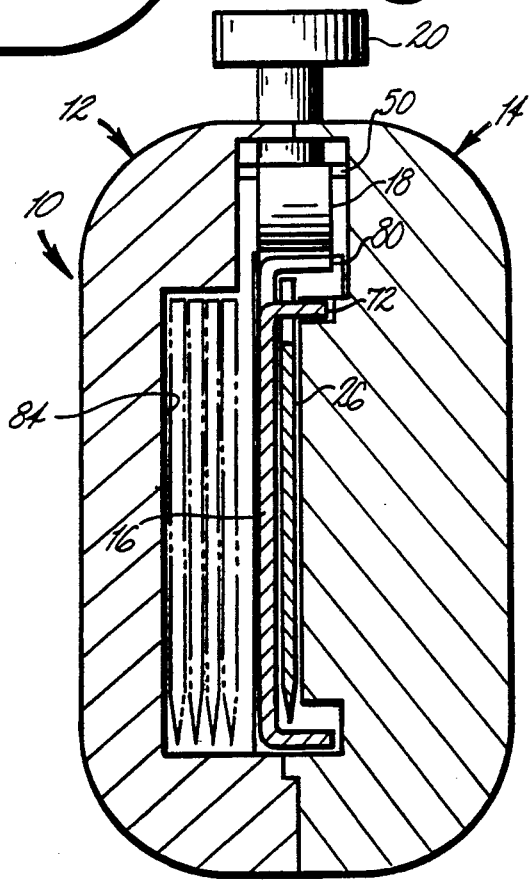
FIG. 5 is a section view in the direction of arrows 5—5 in FIG. 1.

Referring particularly to FIG. 5, an extra blade storage cavity 84 is also provided formed into the interior of housing half 12. Although removal of threaded fastener 30 and separation of halves 12 and 14 are required to access the stored blades, the user does have ready access to extra blades without concern over inadvertent loss or dislodgement of these extra stored blades.

The blade carrier 16 is sized such that its ends 86 and 88 are moved into alignment with the corresponding ends of the device 10 when each of the blades 22 or 26 are in their in-use position. This arrangement is provided to maximize the support provided to each blade 22 and 26 by the blade carrier 16.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A double-ended retractable knife comprising:

a rigid elongated housing having a blade opening at each end and a pair of spaced interior longitudinal guide rails;

an elongated blade carrier slidably mounted in said pair of guide rails and structured at each end to supportively receive and positively position a blade between longitudinally extending flanges of said blade carrier;

said blade carrier selectively longitudinally movable in said pair of guide rails between a central stored position and a first and second in-use position wherein one said blade extends through one said blade opening in said first in-use position and the other side blade extends through the other said blade opening in said second in-use position;

an extra blade storage cavity formed in the interior of said housing;

one said blade has a straight cutting edge while the other said blade has a hooked cutting edge for cutting rope, floor tile, and carpet.

2. A double-ended retractable knife as set forth in claim 1, wherein: said interior guide rails are in very close proximity to said blade carrier and said blades.

3. A double-ended retractable knife as set forth in claim 2, wherein: said blade carrier extends to each end of said housing in said first and second in-use positions to fully support each said blade in use.

4. A double-ended retractable knife handle comprising:

a rigid elongated housing formed of two connectable mating halves about a vertical parting line and having a blade opening at each end thereof;

said mating halves interiorly forming an elongated "C"-shaped longitudinal channel through and terminating at each end of said housing;

a thin blade carrier having an elongated "C" shaped vertical cross section which slidably mates within said housing channel;

said blade carrier sized to positively position a blade at each end of said blade carrier between longitudinally extending flanges of said blade carrier such that each said blade is selectively longitudinally extendable in either direction through one or the other of said blade openings from a central stored position within said blade carrier;

a portion of the upper said flange detached at one end and upwardly curving to a release button at the free end of said detached flange portion, said release button passing through and extending outwardly from an elongated slot formed between said mating halves;

a plurality of detents formed into the interior of said housing adjacent to and extending along said slot which matably engage with said release button in an upwardly spring-biased position of said detached flange portion to releasably secure the longitudinal position of said blade carrier.

5. A double-ended retractable knife as set forth in claim 4, further comprising:

an extra blade storage cavity formed in the interior of said housing accessed by separation of said mating halves.

6. A double-ended retractable knife as set forth in claim 5, wherein:

one said blade has a straight cutting edge while the other said blade has a hooked cutting edge for cutting floor tile and carpet.

7. A double-ended retractable knife as set forth in claim 6, wherein:

said interior guide rails are in very close proximity to said blade carrier and said blades.

8. A double-ended retractable knife as set forth in claim 7, wherein:

each end of said blade carrier extends to the corresponding end of said housing when the corresponding said blade is extended from the corresponding said blade opening during use.

9. A double-ended retractable knife as set forth in claim 8, wherein:

said mating halves also interiorly forming mating longitudinally extending locator rails positioned outwardly adjacent said housing channel for precise positioning and retention of said mating halves one to another.

* * * * *

UNITED STATES PATENT AND TRADEMARK OFFICE

CERTIFICATE OF CORRECTION

PATENT NO. : 5,093,994

DATED : March 10, 1992

INVENTOR(S) : Nick J. Karas

It is certified that error appears in the above-identified patent and that said Letters Patent is hereby corrected as shown below:

Column 3, Line 33, replace "side" with -- said --.

Signed and Sealed this

Fourth Day of May, 1993

*Attest:*

Michael K. Kirk

MICHAEL K. KIRK

*Attesting Officer*

*Acting Commissioner of Patents and Trademarks*